US009744660B2

(12) United States Patent
Jones et al.

(10) Patent No.: US 9,744,660 B2
(45) Date of Patent: Aug. 29, 2017

(54) CONTROL LINE OPERATING SYSTEM AND METHOD OF OPERATING A TOOL

(71) Applicants: Brett Cullen Jones, Broken Arrow, OK (US); Samuel C. Kucera, Tulsa, OK (US)

(72) Inventors: Brett Cullen Jones, Broken Arrow, OK (US); Samuel C. Kucera, Tulsa, OK (US)

(73) Assignee: BAKER HUGHES INCORPORATED, Houston, TX (US)

( * ) Notice: Subject to any disclaimer, the term of this patent is extended or adjusted under 35 U.S.C. 154(b) by 919 days.

(21) Appl. No.: 14/096,314

(22) Filed: Dec. 4, 2013

(65) Prior Publication Data

US 2015/0151421 A1 Jun. 4, 2015

(51) Int. Cl.
*B25F 5/00* (2006.01)
*F15B 20/00* (2006.01)

(52) U.S. Cl.
CPC ..... *B25F 5/005* (2013.01); *F15B 20/004* (2013.01); *F15B 2211/8752* (2013.01); *F15B 2211/8757* (2013.01)

(58) Field of Classification Search
CPC B25F 5/005; F15B 20/004; F15B 2211/8757; F15B 2211/8752; E21B 34/10; E21B 34/101; E21B 34/102; F16K 31/12; F16K 31/122; F16K 31/1225; F16K 31/124; F16K 31/1245
USPC ..... 166/324, 274, 375; 251/62, 63.4; 91/509–510; 60/405–406
See application file for complete search history.

(56) References Cited

U.S. PATENT DOCUMENTS 3,270,507 A * 9/1966 Mercier ..... B63H 25/28 415/145
4,289,165 A 9/1981 Fredd
4,415,036 A 11/1983 Carmody et al.
4,478,286 A 10/1984 Fineberg
4,621,695 A 11/1986 Pringle
(Continued)

FOREIGN PATENT DOCUMENTS

EP 2 094 939 B1 7/2011

OTHER PUBLICATIONS

Kucera, Samuel C., et al., "Bi-Directional Pressure Equalization Valve"; Baker Hughes Incorporated; U.S. Appl. No. 13/737,224, filed Jan. 9, 2013; 14 pages.
(Continued)

*Primary Examiner* — Michael R Reid
(74) *Attorney, Agent, or Firm* — Cantor Colburn LLP

(57) ABSTRACT

A control line operating system includes a first piston having a first pressure face and a second pressure face, a first control line in operable communication with the first pressure face of the first piston, a second piston having a third pressure face and a fourth pressure face and a second control line in operable communication with the third pressure face of the second piston. Both the first piston and the second piston are in operable communication with a tool such that pressure increases in either the first control line or the second control line can cause actuation of the tool, the first control line is in operable communication with the fourth pressure face of the second piston and the second control line is in operable communication with the second pressure face of the first piston.

22 Claims, 3 Drawing Sheets

(56) References Cited

U.S. PATENT DOCUMENTS

| | | | | |
|---|---|---|---|---|
| 4,838,355 | A | 6/1989 | Leismer et al. | |
| 6,427,778 | B1 | 8/2002 | Beall et al. | |
| 7,392,849 | B2 | 7/2008 | Lauderdale et al. | |
| 7,591,317 | B2 | 9/2009 | Bane et al. | |
| 7,878,252 | B2 | 2/2011 | Smith et al. | |
| 8,020,379 | B2 * | 9/2011 | Kakino ..... | F15B 18/00 244/78.1 |
| 2003/0168219 | A1 | 9/2003 | Sloan | |
| 2008/0128137 | A1 | 6/2008 | Anderson et al. | |
| 2009/0188662 | A1 | 7/2009 | Casciaro et al. | |
| 2011/0079394 | A1 | 4/2011 | Plunkett et al. | |
| 2011/0088906 | A1 | 4/2011 | Myerley | |

OTHER PUBLICATIONS

Notification of Transmittal of the International Search Report and the Written Opinion of the International Searching Authority, or the Declaration; PCT/US2014/064081; dated Feb. 23, 2015; 11 pages.

* cited by examiner

CONTROL LINE OPERATING SYSTEM AND METHOD OF OPERATING A TOOL

BACKGROUND

Systems that employ control lines through which pressure is supplied to pistons to actuate tools are in use in industries such as carbon dioxide sequestration and hydrocarbon recovery. Such systems are used to open safety valves by moving a flow tube thereby compressing a spring and opening a flapper, for example. These systems are fail safe since if the control line supplying pressure is breached energy stored in the spring moves the flow tube and piston thereby allowing the flapper to close. Such systems however are inoperable after such a failure has occurred. Industries are therefore receptive to new systems and methods that overcome the aforementioned limitation.

BRIEF DESCRIPTION

Disclosed herein is a control line operating system. The system includes a first piston having a first pressure face and a second pressure face, a first control line in operable communication with the first pressure face of the first piston, a second piston having a third pressure face and a fourth pressure face and a second control line in operable communication with the third pressure face of the second piston. Both the first piston and the second piston are in operable communication with a tool such that pressure increases in either the first control line or the second control line can cause actuation of the tool, the first control line is in operable communication with the fourth pressure face of the second piston and the second control line is in operable communication with the second pressure face of the first piston.

Further disclosed herein is a method of operating a tool. The method includes pressuring up one of a first control line, actuating the tool with the pressuring up, allowing the actuation of the tool to be reversed upon breach of the first control line, pressuring up a second control line and actuating the tool.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
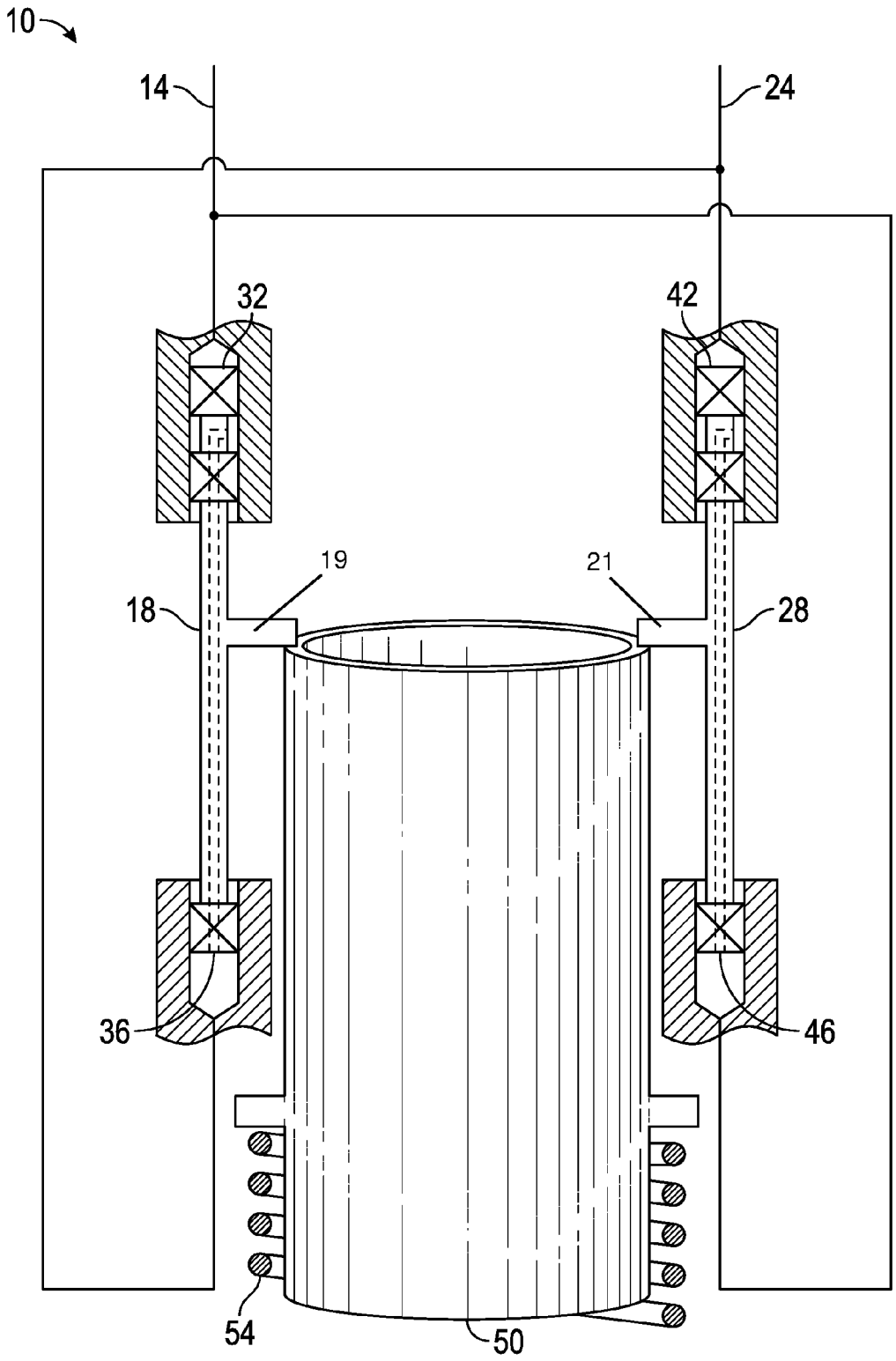
FIG. 1 depicts a schematic of a control line operating system disclosed herein.

Referring to FIG. 1 an embodiment of a control line operating system disclosed herein is illustrated at 10. The control line operating system 10 among other things includes a first control line 14, a first piston 18, a second control line 24 and a second piston 28. The first piston 18 has a first pressure face 32 that is opposite a second pressure face 36 and the second piston 28 has a third pressure face 42 that is opposite a fourth pressure face 46. Pressure applied to the pressure faces 32, 36, 42, 46 urge the respective piston 18, 28 to move. The first control line 14 is in fluidic communication with the first pressure face 32 and the fourth pressure face 46 and the second control line 24 is in fluidic communication with the third pressure face 42 and the second pressure face 36. Both the first piston 18 and the second piston 28 include a feature (19, 21) configured to directly contact a tool 50 shown herein as a flow tube of a safety valve, although the tool 50 could just as well be a component of a ball-type valve, a sliding sleeve-type valve or other type of tool actuatable by movement of one or the pistons 18, 28. A biasing member 54 illustrated as a compression spring in this embodiment urges the tool 50 in a direction opposite a direction the pistons 18, 28 are configured to move the tool 50. The foregoing control line operating system 10 allows the following operations to be performed. Increasing pressure in either the first control line 14 or the second control line 24 will urge the first piston 18 or the second piston 28 respectively in a direction to actuate the tool 50. Breaching of whichever of the first control line 14 and the second control line 24 is pressured up will allow the tool 50 to move in a direction opposite actuation thereof under force provided by the biasing member 54. Subsequent such breaching, the tool 50 can again be actuated by increasing pressure within the control line 14, 24 that was not breached.

In applications wherein the control lines 14, 24 are oriented vertically, such that hydrostatic pressure can build therewithin such as in the hydrocarbon recovery and carbon dioxide sequestration industries, for example, hydrostatic pressure is balanced across the pistons 18, 28. This hydrostatic balancing allows movement of the pistons 18, 28 at lower pressures in the control lines 14, 24 than would be needed if the hydrostatic balancing were not present.

Figure 2:
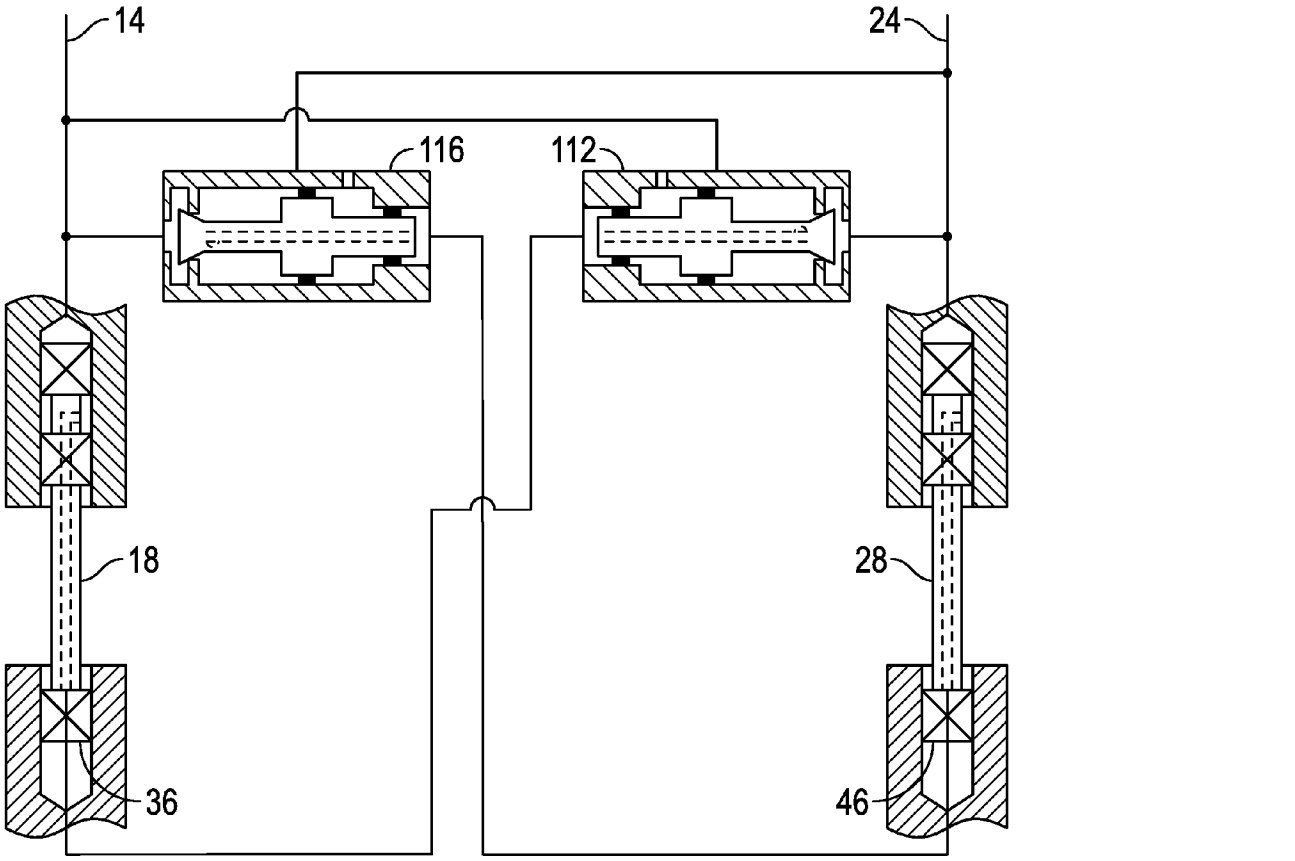
FIG. 2 depicts a schematic of an alternate embodiment of a control line operating system disclosed herein.

Referring to FIG. 2 another embodiment of a control line operating system is illustrated at 110. The operating system 110 is similar to the system 10 but with an addition of a first check valve 112 and a second check valve 116. The first check valve 112 is in fluidic communication with the first control line 14, the second control line 24 and the second pressure face 36 of the first piston 18. Similarly, the second check valve 116 is in fluidic communication with the second control line 24, the first control line 14 and the fourth pressure face 46 of the second piston 28. Both of the check valves are normally closed. The first check valve 112 is openable in response to pressure increases in the first control line 14 that are greater than a threshold value. Once opened, the first check valve 112 allows fluidic communication between the second control line 24 and the second pressure face 36. This fluidic communication allows fluid to flow from the second pressure face 36 when the first piston 18 is moved by pressure built in the first control line 14. And conversely to prevent fluid from flowing out of the second pressure face 36 if the first check valve 112 is not open, thereby hydraulically locking the first piston 18 from moving and preventing actuation of the tool 50 in the process. The fluidic communication allows flow in the opposite direction also to allow fluid to flow into the second pressure face 36 when the first piston 18 moves in an opposite direction in response to pressure reduction in the first control line 14. Thus the first check valve 112 is set to open at pressures within the first control line 14 that are less than pressures needed to move the first piston 18. The system 110 permits continued operation thereof during other failure modes that would render conventional control systems inoperable. The second check valve 116 works in the same manner as the first check valve 112, albeit in relation to the opposite of the control lines and the pistons, and therefore these detailed interactions will not be repeated herein.

The check valves 112 and 116 can be configured similar to the valve 10 described in detail in copending U.S. patent application Ser. No. 13/737,224, filed Jan. 9, 2013, the entire contents of which are incorporated herein by reference.

Figure 3:
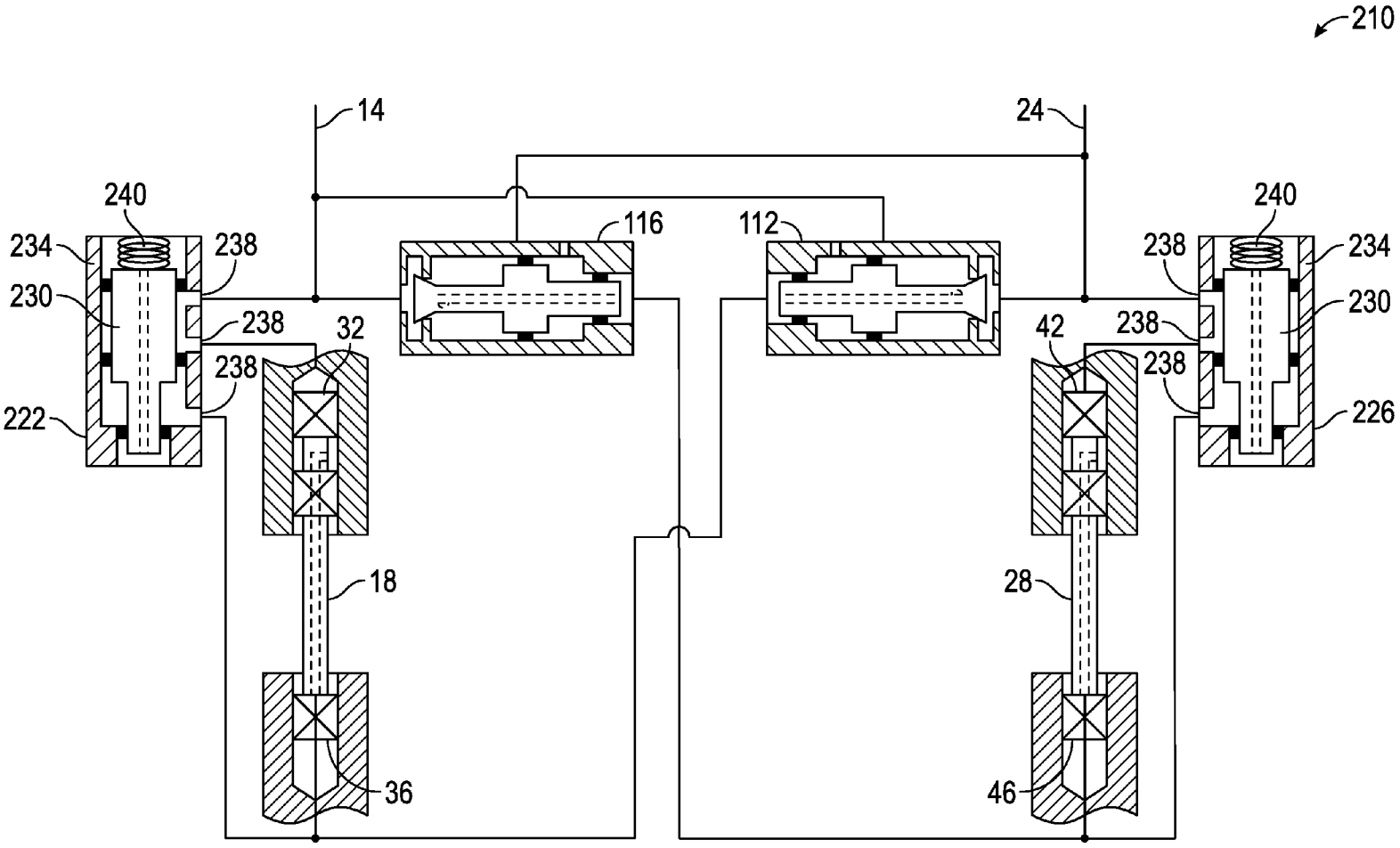
FIG. 3 depicts a schematic of another alternate embodiment of a control line operating system disclosed herein.

Referring to FIG. 3 another alternate embodiment of a control line operating system disclosed herein is illustrated at 210. The control line operating system 210 is similar to the operating system 110 but with an addition of a first fail safe mechanism 222 and a second fail safe mechanism 226. The first fail safe mechanism 222 is configured to fluidically disconnect the first control line 14 from the first piston 18 and fluidically connect the first pressure face 32 with the second pressure face 36 when pressure on the second pressure face 36 drops below a threshold value. This prevents the first piston 18 from becoming hydraulically locked thereby allowing it to be moved with relatively small force. For example in vertical applications forces as small as that needed to lift the weight of the moving parts (including fluid) and overcome any friction may be sufficient. Such a force can be provided by the biasing member 54.

The first fail safe mechanisms 222 of the illustrated embodiment includes a member 230 sealingly movable engaged within a housing 234 with ports 238 in fluidic communication with the first control line 14, the first pressure face 32 and the second pressure face 36. A differential area of the member 230 allows pressure from the second pressure face 36 to urge the member 230 against a biasing arrangement 240 (and weight of the member 240 if oriented vertically) to maintain fluidic communication of the first control line 14 with the first pressure face 32 through the ports 238 in the housing 234. Upon a drop of pressure, below a threshold value, in the second pressure face 36 the biasing arrangement 240 (and weight of the member 240 if applicable) moves the member 230 to a position wherein fluid communication between the first control line 14 and the first piston 18 is blocked and allows fluid communication between the first pressure face 32 and the second pressure face 36 thereby hydraulically balancing fluid forces across the first piston 18 allowing it to be easily moved by the force of the biasing member 54, for example. Although the embodiment of the first fail safe mechanism 222 illustrated is a valve, other embodiments can be in the form of other mechanisms.

The second fail safe mechanism 226 operates in a similar manner to that of the first fail safe mechanism 222, albeit in relation to the other of the control lines and the pistons and as such the details of its operation will not be repeated herein.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A control line operating system comprising:

a first piston having a first pressure face and a second pressure face;

a first control line in operable communication with the first pressure face of the first piston;

a second piston having a third pressure face and a fourth pressure face; and a second control line in operable communication with the third pressure face of the second piston, both the first piston and the second piston having a feature configured to directly contact a tool that is fluidly separated from the control line operating system such that a sufficient pressure increase in either the first control line or the second control line causes actuation of the tool, the first control line being in operable communication with the fourth pressure face of the second piston and the second control line being in operable communication with the second pressure face of the first piston.

2. The control line operating system of claim 1, wherein both the first piston and the second piston are pressure balanced by hydrostatic pressure being applied to opposing pressure faces thereof.

3. The control line operating system of claim 1, wherein the first piston is operational to actuate the tool in response to pressure increases in the first control line even if the second control line is breached and the second piston is operational to actuate the tool in response to pressure increases in the second control line even if the first control line is breached.

4. The control line operating system of claim 1, wherein a biasing member resists actuation of the tool.

5. The control line operating system of claim 4, wherein breaching of either the first control line or the second control line will allow the biasing member to move the tool opposite a direction of actuation of the tool.

6. The control line operating system of claim 5, wherein pressure increases in the control line not breached can actuate the tool.

7. A control line operating system comprising:

a first piston having a first pressure face and a second pressure face;

a first control line in operable communication with the first pressure face of the first piston;

a second piston having a third pressure face and a fourth pressure face; and a second control line in operable communication with the third pressure face of the second piston, both the first piston and the second piston being in operable communication with a tool such that a sufficient pressure increase in either the first control line or the second control line causes actuation of the tool, the first control line being in operable communication with the fourth pressure face of the second piston and the second control line being in operable communication with the second pressure face of the first piston, wherein the tool is a component selected from the group consisting of a ball-type valve, a sliding sleeve-type valve and a flow tube-type safety valve.

8. The control line operating system of claim 1, further comprising a first check valve in operable communication with the first control line, the second control line and the second pressure face to allow fluidic communication between the second pressure face and the second control line when pressure in the first control line is greater than a threshold pressure.

9. The control line operating system of claim 8, further comprising a second check valve in operable communication with the second control line, the first control line and the fourth pressure face to allow fluidic communication between the fourth pressure face and the first control line when pressure in the second control line is greater than a threshold pressure.

10. A control line operating system comprising:

a first piston having a first pressure face and a second pressure face;

a first control line in operable communication with the first pressure face of the first piston;

a second piston having a third pressure face and a fourth pressure face; and a second control line in operable communication with the third pressure face of the second piston, both the first piston and the second piston being in operable communication with a tool such that a sufficient pressure increase in either the first control line or the second control line causes actuation of the tool, the first control line being in operable communication with the fourth pressure face of the second piston and the second control line being in operable communication with the second pressure face of the first piston, further comprising a first fail safe mechanism in operable communication with the first control line, the first pressure face and the second pressure face such that fluid communication is maintained between the first control line and the first pressure face when pressure in the second pressure face is at or above a threshold value and fluidic communication between the first control line and the first pressure face is blocked when the pressure in the second pressure face is below the threshold value.

11. The control line operating system of claim 10, wherein the first pressure face and the second pressure face are in fluidic communication through the first fail safe mechanism when the pressure in the second pressure face is below the threshold value.

12. The control line operating system of claim 10, wherein the first fail safe mechanism is a valve.

13. The control line operating system of claim 10, further comprising a second fail safe mechanism, the second fail safe mechanism being in operable communication with the second control line, the third pressure face and the fourth pressure face in a manner similar to how the first fail safe mechanism is in operable communication with the first control line, the first pressure face and the second pressure face.

14. A method of operating a tool with the control line operating system of claim 1, comprising:

first pressuring up one of the first control line or the second control line;

actuating the tool with the pressuring up;

allowing the actuation of the tool to be reversed upon loss of pressure in the line pressured up upon in the first pressuring up;

pressuring up the other of the first control line or the second control line; and actuating the tool.

15. The method of operating a tool of claim 14, wherein the actuating the tool is via movement of either the first piston with pressuring up of the first control line or the second piston with pressuring up of the second control line.

16. The method of operating a tool of claim 15, further comprising applying pressure from the first control line to the second piston in a direction opposing movement of the second piston by pressure in the second control line and applying pressure from the second control line to the first piston in a direction opposing movement of the first piston by pressure in the first control line.

17. The method of operating a tool of claim 15, further comprising applying hydrostatic pressure to both pressure faces of the first piston and both pressure faces of the second piston.

18. The method of operating a tool of claim 17, further comprising hydraulically preventing movement of the first piston by trapping fluid against the first piston in a direction opposing movement of the first piston due to pressure within the first control line.

19. The method of operating a tool of claim 18, wherein the trapping fluid is by maintaining a valve in a closed position.

20. The method of operating a tool of claim 15, further comprising isolating the first piston from pressure within the first control line with a fail safe mechanism.

21. The method of operating a tool of claim 20, further comprising fluidically connecting opposing pressure faces of the first piston to one another with the fail safe mechanism.

22. The method of operating a tool of claim 14, further comprising moving the tool, the tool selected from the group consisting of ball-type valve, a sliding sleeve-type valve and a flow tube-type safety valve.

* * * * *